United States Patent [19]

Ekholm

[11] 4,346,789

[45] Aug. 31, 1982

[54] LIFT BATTERY CONTROL SYSTEM

[75] Inventor: Ralf C. Ekholm, Helsinki, Finland

[73] Assignee: Elevator GmbH, Zug, Switzerland

[21] Appl. No.: 149,112

[22] Filed: May 8, 1980

[30] Foreign Application Priority Data

May 16, 1979 [FI] Finland ..... 791570

[51] Int. Cl.[3] ..... B66B 1/18

[52] U.S. Cl. ..... 187/29 R

[58] Field of Search ..... 187/29

[56] References Cited

U.S. PATENT DOCUMENTS 4,081,059 3/1978 Kuzunuki et al. ..... 187/29

4,114,730 9/1978 Means et al. ..... 187/29

*Primary Examiner*—J. V. Truhe

*Assistant Examiner*—W. E. Duncanson, Jr.

*Attorney, Agent, or Firm*—Martin Smolowitz

[57] ABSTRACT

Lift battery control system comprising a plurality of lift cages 1 serving a plurality of storey levels 108, where there are means 10,11 for making calls from these levels, and means for determining the location of the lift cage, and for said lift cages control means 1,2,3 . . . containing one or several microcomputers 14 with, among other things, one or several microprocessors 24, and which control means 1,2,3 . . . further contain lift cage drive means 4 and a control apparatus controlling the lift cage drive means 4. The microcomputers 14 constitute a data processing unit 18, which in the joint-controlled lift battery, together with the data processing units 18 of all the other control means 1,2,3 . . . belonging to the battery and controlling separate lift cages, also carries out the controlling of the battery.

18 Claims, 12 Drawing Figures

LIFT BATTERY CONTROL SYSTEM

Figure 1:
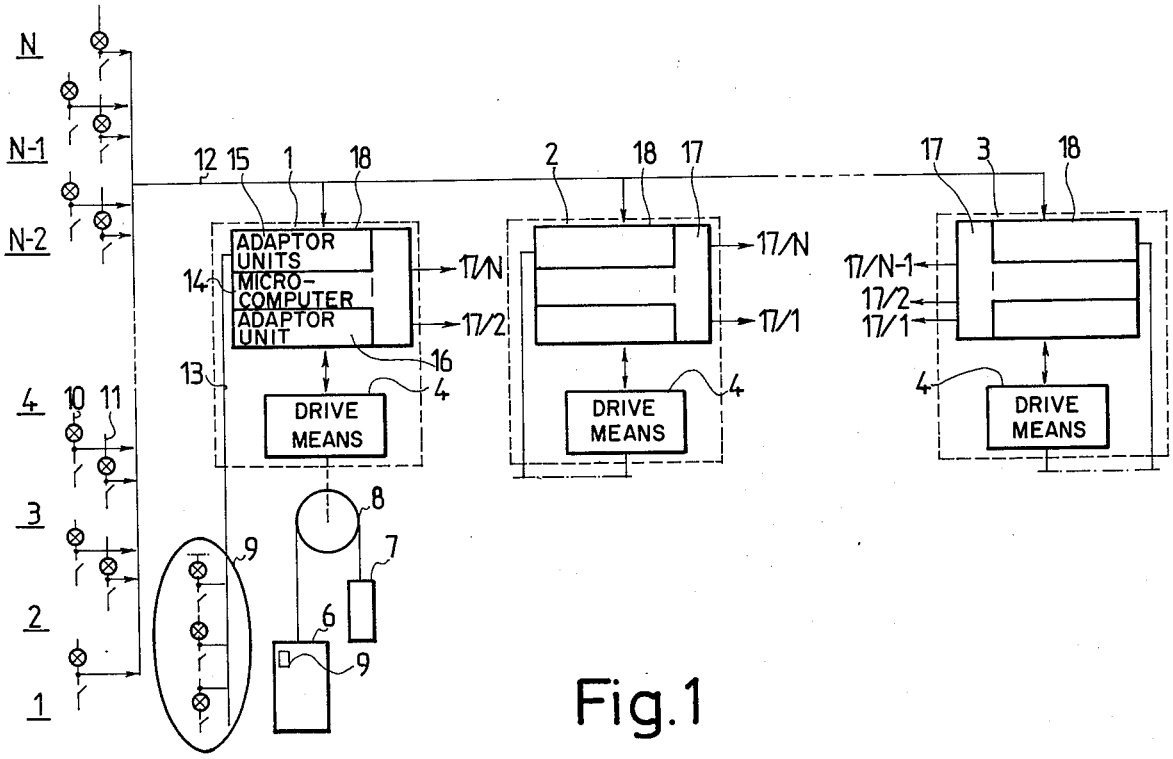

The present invention concerns a lift battery control system comprising a plurality of lift cages catering for a number of floor levels having means for entering calls from these levels and means for determining the location of the lift cage and within said lift cages means for entering calls from the cages and means for determining the location of the lift cage and for said lift cages control means comprising one or several microcomputers with among other things one or several microprocessors, and which control means further contain lift cage drive means and a control apparatus controlling the lift cage drive means.

It is highly desirable that the design of the lift battery control should be such that in failure cases it will enable operation of separate lifts and, if possible, will also perform battery control by the aid of a reserve control system. A procedure is known in the art which monitors the calls coming from the levels, henceforth to be called external calls, and if such have not been served within a specified time, the control system will revert to a simple reserve mode wherein it distributes all external calls to all lifts. This problem solution has several drawbacks. One important such is that the separate lifts are not moving in coordinated manner, whereby the standard of service is considerably impaired. Random waiting times of exceedingly great length also become likely. The procedure furthermore has the weak point that when the unit receiving external calls changes, the external calls cannot be distributed at all or, if the respective external call input circuit are so constructed that call transfer to the drive control is possible even if the said unit develops a fault, it becomes necessary in the entire system to employ complicated adaptor circuits in great number.

Also known is a procedure wherein the separate lifts go over to a control of bus traffic type, and in large batteries one has frequently endeavoured to enhance this by assigning in advance to each lift certain specific floors, for instance so that for lift No. 1 have been reserved floors No. 1,5,9 . . . , for lift No. 2 the floors No. 2,6,10 . . . etc. This procedure has for instance the weak point that if some of the lifts are stationary owing to repairs or maintenance, for instance, then some of the floors may be totally missed by the service.

Also known in the art are procedures in which the fundamental problem solutions described have been carried out in such way that either the battery control unit or the control means of the lift cage, or both, have a microcomputer. The detriments consequent on the procedures described encumber these applications as well.

In addition, the problem solutions carried out as described introduce a new harmful factor, compared with procedures carried out by conventional techniques. The microcomputers are operating under comparatively difficult conditions in the lift system, and the voltages and currents employed are very small compared with the existing conditions. Moreover, data transfer and processing are fast. This has the consequence that they are to some extent prone to interference. This problem is in general solved in that the microcomputer proper is galvanically isolated from the ambient world. The means of isolation are most usually either relays or so-called optoisolators. Since the lift system is physically quite extensive and it has a remarkable number of arrivals and departures, any system solutions which distribute the external calls both to the battery control unit and to the control means of all lift cages and employ optoisolators in every call line are economically unfavourable. It is also to be noted that reasonably priced optoisolators are rather much less reliable that conventional electronic components, for which reason the incorporation of such in the system in great numbers will lower the theoretical defect interval of the whole system to a level which is on the order of a few months. Alternatively, the use of high quality optoisolators in great numbers is expensive. In an application of prior art there are used two optoisolators per external or internal call line, whereby in a medium-sized lift battery, e.g. one comprising four lifts and 16 stories, there are needed in each lift merely for separating call lines: 92 optoisolators, and which makes 428 optoisolators for the entire battery.

The system of the invention is characterized in that the microcomputers constitute a data processing unit which in the integrally controlled lift battery together with the data processing units of all the other control means belonging to the battery and controlling separate lift cages also carries out controlling of the battery. Hereby the advantage is gained, among others, that since the battery controlling is not effected in one separate apparatus, instead of which is actual fact the battery controlling capacity is incorporated in a plurality of apparatus units having the ability to carry on with the operation even if one or several apparatus units in the system should cease to operate, the operation of the whole battery is not dependent on the reliability of one piece of apparatus.

One embodiment of the invention is characterized in that in the system route of each data processing unit has been incorporated a route isolator, which is so designed that on its other side is another route, that is the lift route, which has been galvanically isolated fromnm the system route. Among others, the system of the invention has the advantage that the number of optoisolators required is very low.

Another embodiment of the invention is characterized in that the storage units of the data processing units of the lifts included in the joint lift battery control contain, for implementing the steering strategy, similar sets of actions in all lifts belonging to the joint control. Hereby the advantage is gained that all control units are identical in this respect in the lift battery, which makes their manufacturing, testing, maintenance etc. more advantageous.

A third embodiment of the invention is characterized in that the data processing units are equal in rank in their mutual relations of interdependence.

One embodiment of the invention is also characterized in that the storage units of all data processing units of the lift battery participating in the joint control at any given time carry the same information regarding the battery's external calls.

One embodiment of the invention is also characterized in that the data processing units participating in joint control perform joint control of the lift battery simultaneously. The advantage hereby gained is that if one apparatus develops a fault the joint control may continue with the existing data instead of being compelled to start at the beginning, as is the case in a centrally controlled or an alternating system.

One embodiment of the invention is also characterized in that all external calls have been connected to all control units of separate lifts participating in joint control of the battery. The advantage hereby gained is that the operation of the entire battery cannot be paralysed by a separate, so-called external call memory developing a fault.

One embodiment of the invention is also characterized in that the data transfer units are so interconnected that there is from each lift cage control means at least one direct path of communication to all the other lift cage control means. The advantage hereby gained is that in the case of failure of one data transfer connection there remains, depending on the size of the battery, whenever the battery contains three or more lifts, at least one indirect path of communication from each data processing unit to each other the data processing unit.

One embodiment of the invention is also characterized in that the data processing units carry out a series of steps on the basis of which through said data transfer units signals are transferred to other data processing units in a manner such that data processing cycles are created which have equal length in all data processing units of the control means. The advantage hereby gained is that location coding may be employed in the data transfer, whereby the amount of data to be transferred is reduced, thus simplifying the testing and maintenance procedures of the data transfer.

One embodiment of the invention is also characterized in that any one of the data processing units dispatching signals or receiving signals may send a first signal, or so-called synchronizing signal, and in case the data processing unit which sent the synchronizing signal ceases to send synchronizing signals, any other data processing unit may start the next cycle by in its turn sending the synchronizing signals to the other data processing units. The advantage hereby gained is that in the event of one piece of apparatus developing a fault the system continues to operate, maintaining full synchronism, even if the faulty apparatus would happen to be exactly the one which was at that particular moment sending synchronizing signals to the others.

One embodiment of the invention is also characterized in that during the data processing cycle each data processing unit performs a series of steps so that during the data processing cycle for each own control means will be selected one or several external calls.

One embodiment of the invention is also characterized in that each data processing unit when observing, while carrying out said series of steps, a free call or a call with a lower rated booking compared with its own running situation, will carry out a series of steps which are such that those data processing unit which have not yet, while performing the first series of steps, noticed the external call in question receive notice of this booking as they are performing the first series of steps, before in their stepping they have arrived at the point where said external call is going to be observed. The advantage hereby gained is that the data processing unit receiving bookings need not perform any comparisons regarding the bookings which arrive, whereby it also need not be away which of the control means has dispatched which booking. Hence follows that the call selection and booking system will be independent of the size of the lift battery.

One embodiment of the invention is also characterized in that at the same time while the above-mentioned second series of steps is being carried out, the said first series of steps continues its progress until all external calls have been dealt with or all check rounds have been made, and if it finds further external calls with a lower rated booking as compared with the own running situation and the before-booked external call, the said second series of steps is re-performed for this second call, however so that this second call is given a lower rated booking and that hereafter the procedure continues in the same manner in principle, so that on each round the booking is lower in rating than on the preceding round, the number of rounds being small as a rule—for instance 2, 3 or 4. The advantage gained by this procedure is that the lift services in a building will be centered around the point where the calls are most numerous.

One embodiment of the invention is also characterized in that the data processing units participating in joint control perform joint control of the lift battery so that they operate mainly simultaneously and that at the end stages of the data processing cycle they have the same information concerning the battery's external calls. The advantage hereby gained is that the data processing units need not necessarily operate in mutual synchronism.

One embodiment of the invention is also characterized in that the data processing units are so interconnected that there is from each lift cage control means at least one indirect path of communication to all other lift cage control means. The advantage hereby gained is that the requisite number of data transfer units is less.

One embodiment of the invention is also characterized in that each lift cage control means is connected to an external call storage unit serving as joint memory storage for the data processing units of the control means of all lift cages. The advantage hereby gained is that no conflict situation can arise between different data processing units.

One embodiment of the invention is also characterized in that each lift cage control means is connected to an external call processing unit which assigns to each external call a weight value in accordance with the number of persons which the sensor system monitoring the stopping level states will enter the cage when the call comes to be served. The advantage hereby gained is that the battery control strategy is enabled to make more exact decisions.

One embodiment of the invention is also characterized in that through the route isolator can be transferred also information passing from the data processing unit to the drive means and information passing from the drive means to the data processing unit, said route isolator being such that the data from the drive means may induce an interrupt in the data processing unit.

Referring to the attached drawings, an embodiment of the invention is described in the following. In the figures the common practice of block diagram drawing has been applied, letting a continuous, heavy lead represent a plurality of mutually equivalent connections which do not transfer data in synchronized time; and whenever a route is concerned where data are transferred in time-synchronized mode, this has been drawn in the form of a separate, comparatively narrow field and, in the instance of single or very few control lines, these have been indicated by discrete lines. The direction of flow is from left to right or from top to bottom unless otherwise implied by exceptional circumstances, in which case the deviant direction of flow has been clearly indicated with an arrow. In the interest of simplicity, the majority of modules have also been shown as block diagrams, and the designations of the blocks conform to general practice, which enables a person skilled in the art to understand with ease both the principal operation of each block and those other connections and their circuitry which have not been indicated in the block.

The simplified block diagram depicted in

FIG. 1 illustrates the lift system.

Figure 2:
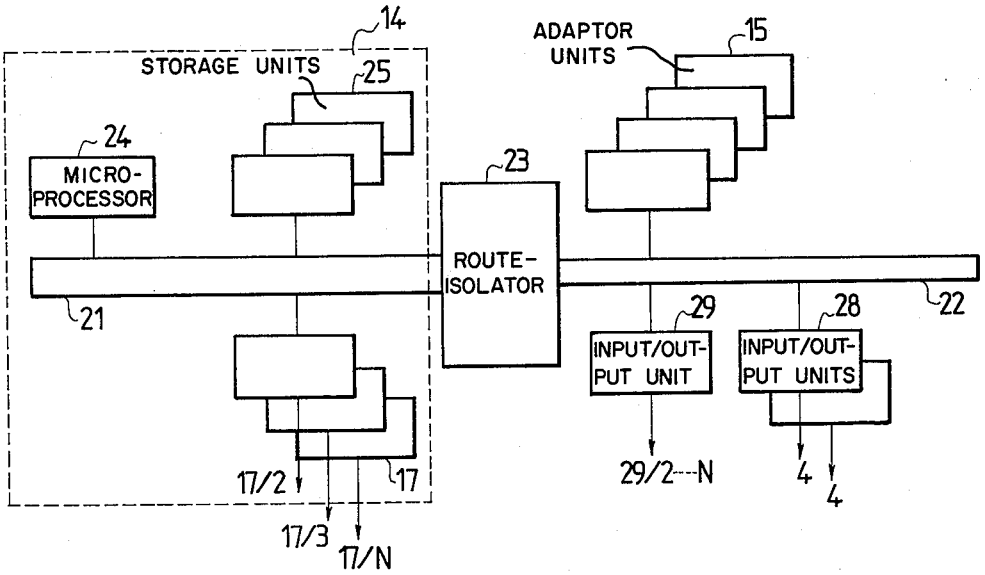

FIG. 2 presents the simplified block diagram of the data processing unit of a single lift cage control means.

Figure 3:
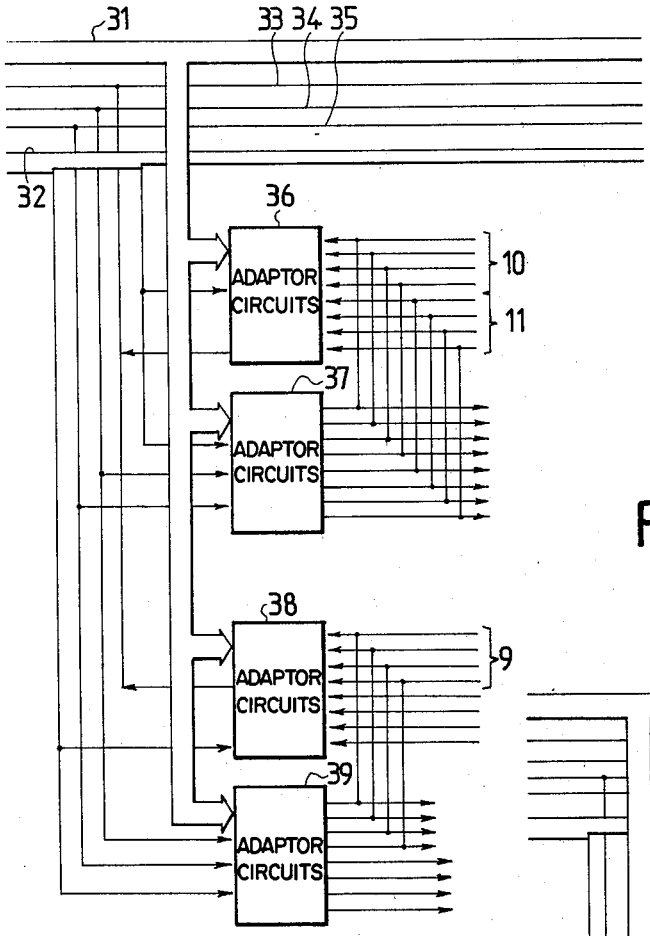

FIG. 3 presents the simplified schematic diagram of a call adaptor unit.

Figure 4:
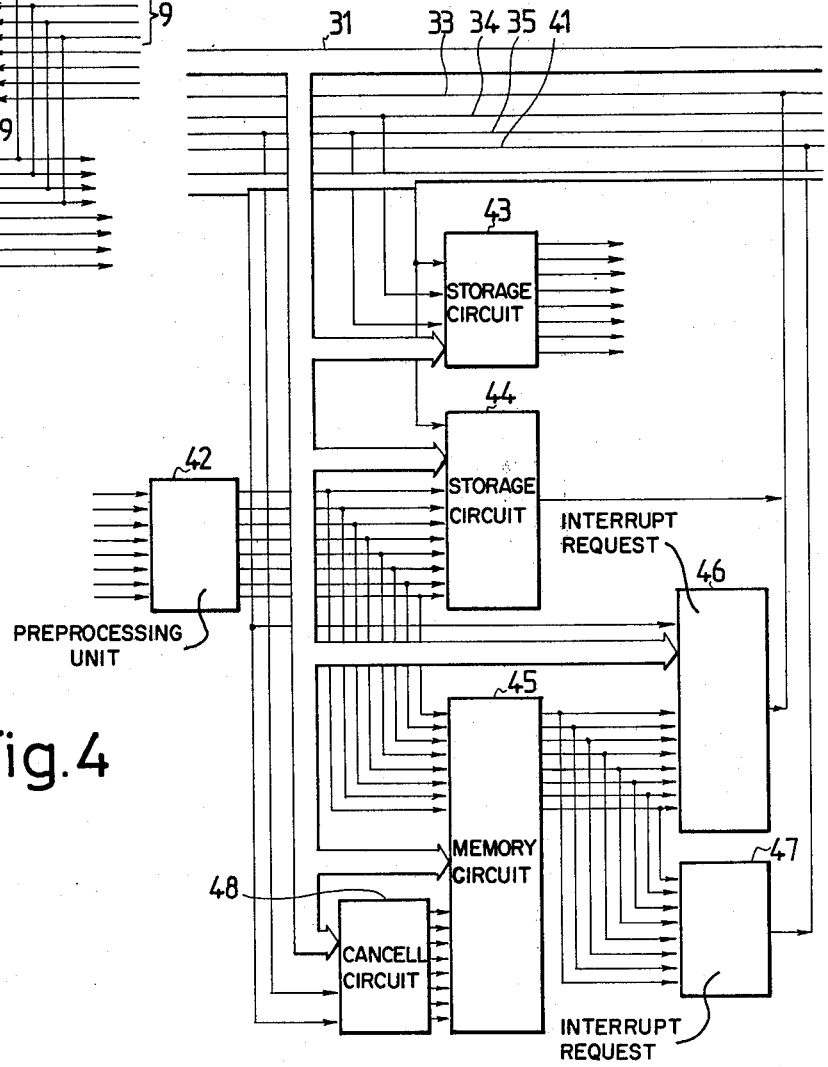

FIG. 4 presents the simplified schematic diagram of a input/output unit.

Figure 5:
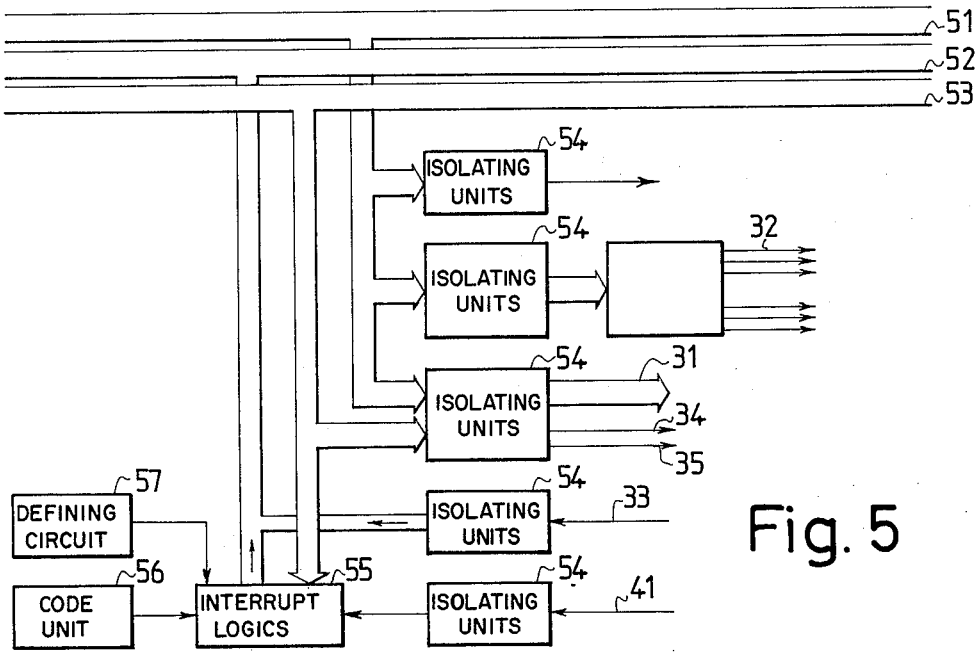

FIG. 5 presents the simplified schematic diagram of a route isolator.

Figure 6:
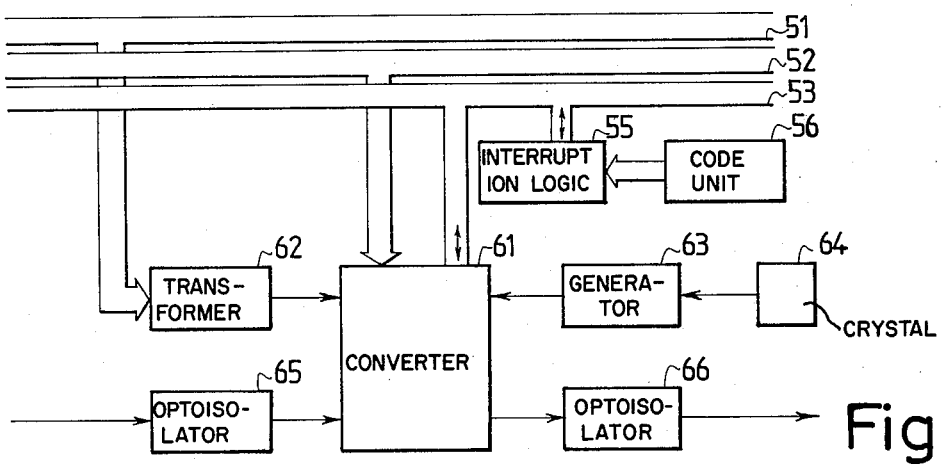

FIG. 6 presents the simplified schematic diagram of a data transfer unit.

Figure 7:
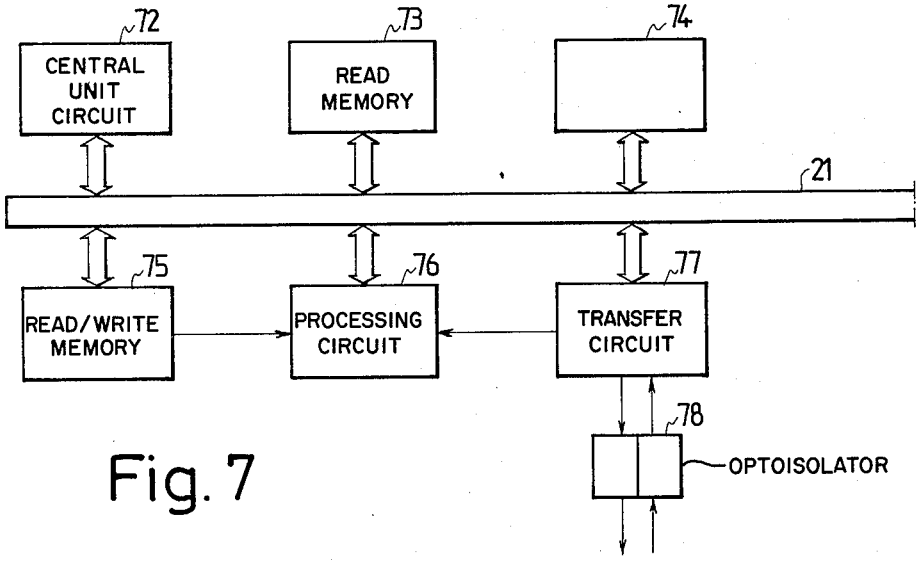

FIG. 7 presents the simplified schematic diagram of a microprocessor.

Figure 8:
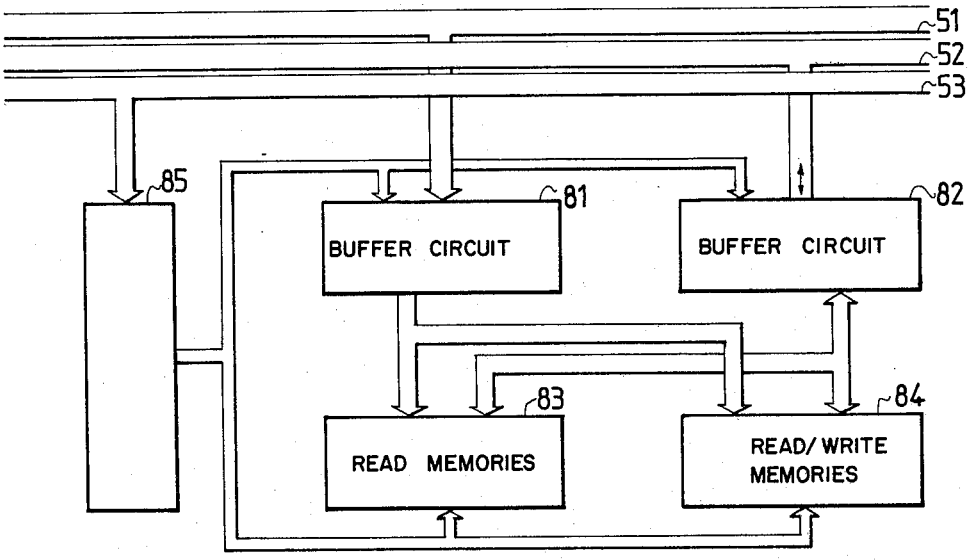

FIG. 8 presents the simplified schematic diagram of a storage unit.

Figure 9:
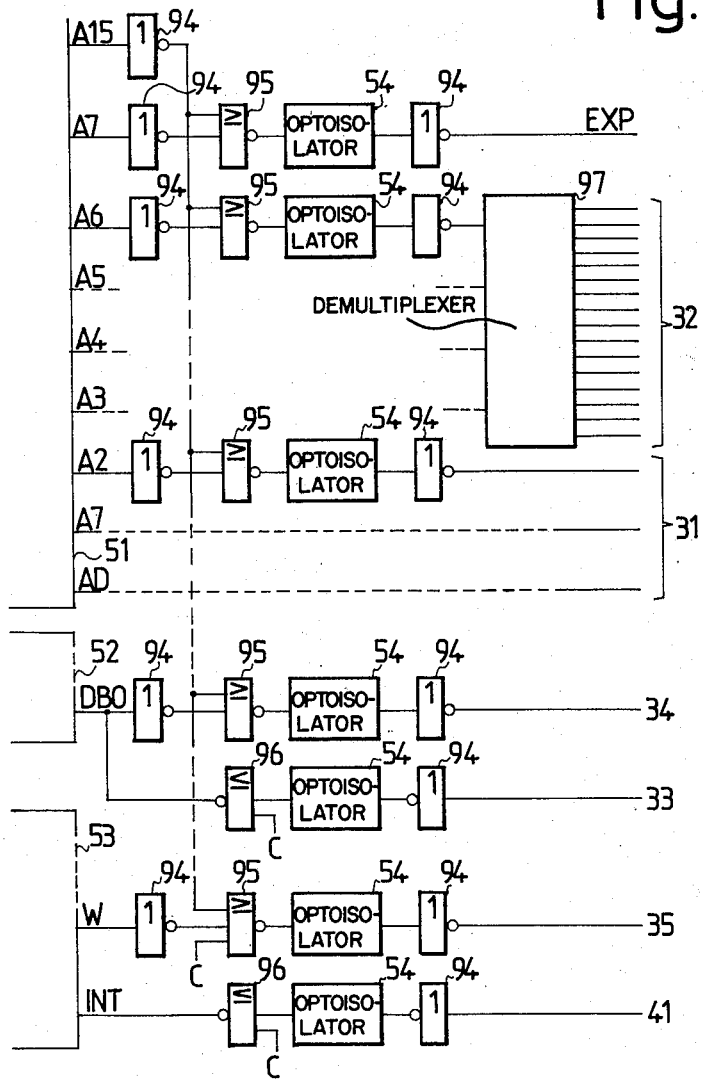

FIG. 9 presents the simplified circuit diagram of the route isolator.

Figure 10:
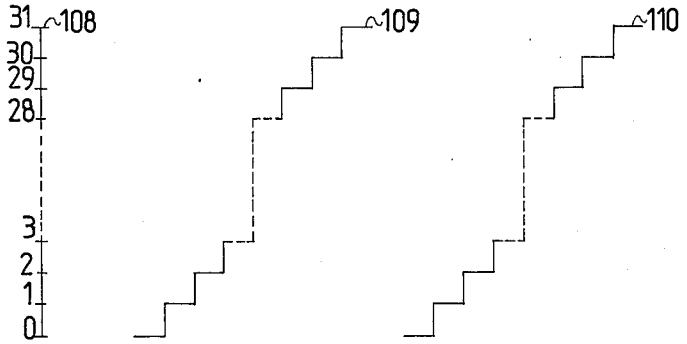

FIG. 10 presents the time axis employed by call selection and data transfer.

Figure 11:
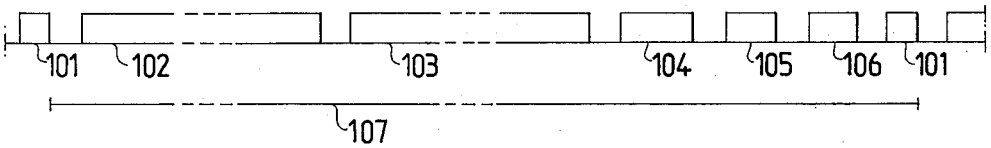
Figure 11:
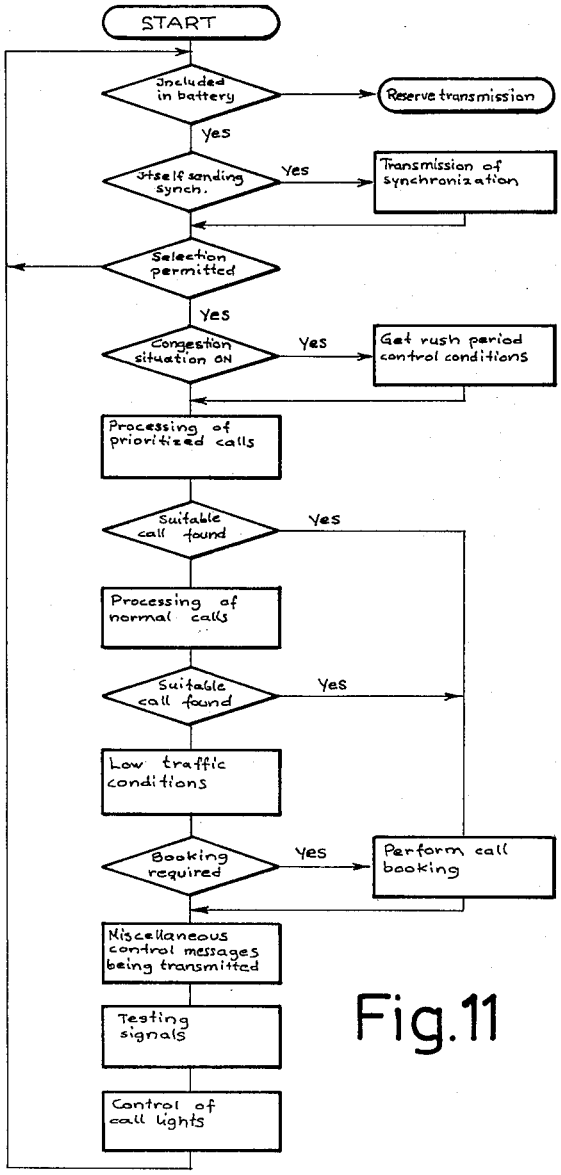

FIG. 11 presents the main flow of battery control steps.

Figure 12:
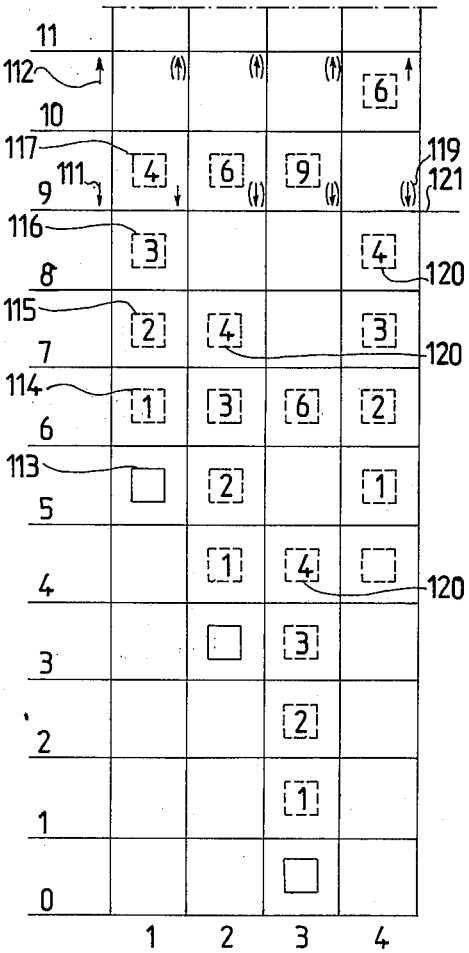

FIG. 12 presents the lift battery.

The simplified block diagram depicted in FIG. 1 illustrates a lift system with a plurality of lift cage control means 1,2,3, and associated with them a plurality of lift cage drive means 4, and the cage 6 of lift No. 1, its counterweight 7, its set of return shieves 8, and within the cage, cage call buttons and signal lights 9, and external calls on the levels, upward calls 10, downward calls 11. It is further readable from the figure that all calls coming from a level have been connected to all cage control means over a common call connecting line 12 and that the internal calls of each cage have been connected to the control means of the respective cage by the line 13. It is further readable from the figure that the control means of each lift cage consists of four main parts, which are: a microcomputer 14, call adaptor units 15, data transfer units 17, and a drive means adaptor unit 16 comprising one or several input/output units 29. The number of data transfer units 17 depends on the number of lifts so that from each data transfer processing unit 18 there is a connection to each other data processing unit 18.

FIG. 2 presents the simplified block diagram of the data processing unit 18 of one lift cage's control means. This comprises the system route 21, the lift route 22 and the route isolator 23. Connected to the system route 21 are one or several microcomputers 14, comprising among other things, one or several microprocessors 24; further connected to the system route 21 are one or several storage units 25 and one or several data transfer units 17. Connected to the lift route 22 are one or several call adaptor units 15 one or several input/output units 28 for connection to the lift cage drive means and one separate input/output unit 29 for connection to the equivalent unit of the other data processing units 18. The connections of the units to the routes conform to common practice and to the instructions given by the manufacturers of the circuits used, and they are not described in greater detail therefore.

FIG. 3 presents a simplified schematic diagram of the call adaptor unit 15, comprising the lift route's signal selecting route 31, signal group selection 32 and signal reception line 33, signal transmitting line 34 and control line 35 for printing. Also shown in the figure are two pairs of adaptor circuits 36,38 for connection to call lines, and which have the task to receive the incoming call and to enable consecutive examination of the plurality of calls that will be connected thereto, in such manner that those call lines in which a call has been pressed can be identified and information thereof can be sent over the lift route 22 to the microprocessor 24. Furthermore, the unit comprises two call adaptor circuits 37,39 in which the call datum that has arrived through the circuit mentioned may be stored after its processing in the microprocessor 24. The reading and storing operations are performed with the aid of the route and control lines seen in the figure, conforming to common practice, and therefore this shall not be described here in any greater detail.

In FIG. 4 has been presented a simplified schematic diagram of the input/output unit 28, comprising in addition to the routes and control lines mentioned, an interrupt request line 41. Moreover, the unit comprises the preprocessing unit 42 of the input circuits, the storage circuit 43 of the outputs, and the storage circuit 44 of the inputs, the latter being so carried out that it enables the input lines to be consecutively examined, on the basis of which the active input lines can be established. Furthermore, the unit comprises, connected to the input lines mentioned, circuits for determining the time of arrival of the signal, and whereof 45, 46 and 47 in combination formulate the so-called interrupt request to the microprocessor, and 48, which enables the interrupt request stored in the memory circuit 45 to be cancelled. The circuit 46 enables the interrupt requests to be consecutively examined, so that the active interrupt request lines can be identified, and the circuit 47 performs on the interrupt request lines a so-called OR operation, which is a concept familiar to persons skilled in the art and therefore shall not be more closely described.

FIG. 5 presents a simplified schematic diagram of the route isolator 23, comprising the partial routes of the system route 21, address route 51, data route 52, control route 53. The task of this unit is to galvanically separate the data processing part from the remaining control and drive part of the lift, and it comprises the galvanic isolating units 54. These contain commonly used optoisolator circuits and requisite additional components thereto. The route isolator 23 connects to the data processing system, employing therein the interrupt processing logics 55. The apparatus code required in interrupt processing is defined in the apparatus code unit 56, and the interrupting apparatus priority code required in said system is defined in the defining circuit 57. The circuits 56 and 57 conform to common practice and are not more closely described. For interrupt system of the microcomputer unit has been chosen a medium-speed commonly known system, wherein those means which may interrupt are chained and the route isolator is in this chain one apparatus of which the internal interrupting system is based on programmed identification. The systems concerned are so common and clear to a person skilled in the art that they shall not be more closely described here. The above-mentioned signal group selection of the lift route 22 has a design such that two lines have been reserved for each unit. These lines are demultiplexed from the actual address in the respective unit 58. In addition, the route separator 23 comprises the parts of the lift route mentioned before 31, 32, 33, 34, 35 and 41.

FIG. 6 presents a simplified schematic diagram of the data transfer unit 17, comprising the partial routes of the system route, address route 51, data route 52 and check route 53, and connected to these an interruption logic 55 of the kind related above and thereto connected, the apparatus code unit 56. Moreover connected to the routes is a series/parallel and parallel/series converter 61, and thereto connected a code transformer 62, a bit frequency generator 63, and thereto connected the crystal 64. To the series/parallel and parallel/series converter unit have further been connected two optoisolators 65 and 66. The data transfer unit 17 connects to the interrupt processing of the system in similar manner as the unit just mentioned. As regards the formulation of the system interrupt request, the circuit itself identifies internally directly the interruptions of transmitting and reception. The said units conform to common designing practice and shall therefore not be described more closely. The data transfer method used is the commonly known so-called current loop principle.

FIG. 7 presents a simplified block diagram of the microprocessor 24, where to the system route 21 have been connected the central unit circuit 72 and the auxiliary circuits which it requires, read memory 73, and read/write memory 75, interrupt request processing circuit 76, and series-form data transfer forwarding circuit 77, so that the said timer circuit and the data transfer forwarding circuit directly induce interrupts in the interrupt request processing circuit, where also are present—equivalent with these interrupts in other respects except for timing—the interrupts created in the above-mentioned units 17, 28 and 29. To the series-form data transfer forwarding circuit 77 have also been connected two optoisolators 78. The design and operation of the unit conforms to common practice and shall therefore not be described in greater detail.

FIG. 8 presents a simplified schematic diagram of the storage unit 25, where to the partial routes of the system are connected the buffer circuits 81 and 82. To these are connected the read memories 83, and read/write memories 84, and the control circuits 85 controlling the buffer and memory circuits. These circuits conform to common practice and are therefore not more closely described here.

FIG. 9 presents the simplified circuit diagram of the route isolator 23, with the system route's address route 51, its data route 52 and its control route 53. The symbols A0–A15 represent the address lines of the address route; similarly, in the data route DBO represents the first line of this route, and W and INT represent two control lines of the control route. The figure further contains logic symbols conforming to common practice. The circuits shown are common commercially available circuits. Over the symbols their type designations have been entered. For greater clarity, part of the circuits have not been drawn. The signals presented near the right margin are connected to adaptor units in accordance with the block diagrams presented. The signal EXB is only used in the extended system, indicated with C in the figure.

The lines connect with other lines of the control route, conforming to commonly known principles, and therefore they shall not be more closely described here. In the interest of clarity, a number of auxiliary components have also been omitted from the figure. The circuits 94 are buffer or inverter circuits, the circuits 95 enable synchronous addressing with the computer itself, circuits 96 synchronize the other activities with the computer itself. The circuits 54 are optoisolators, mentioned before, and circuit 97 is a demultiplexer.

FIG. 10 presents the time axis employed by call selection and data transfer, with 101 the time reserved for synchronizing, 102 the time for special selections, 103 the time for normal selections, 104 the time for other messages, 105 the testing time and 106 the light-control time. The length of the whole cycle is represented by 107, the storey levels by 108, the progress of selection during special selection by 109 and during normal selection, by 110.

FIG. 11 presents the main flow of battery control steps. The concepts appearing in the diagram are commonly known or will be evident from the description following.

FIG. 12 displays a lift battery wherein the series of numerals 1–4 represents the lifts, the series 0–11 represents the levels and 11 stands for a "Down" call, 112 for an "Up" call, 113 indicates the cage of lift No. 1 at the beginning of the situation under consideration and 114, the location of lift No. 1 after the first stepping performed by its data processing unit 118, 115 indicates the same after the second stepping, 116 after the third, 117 after the fourth stepping etc., and 118 stands for a booked call, and 119 for an inhibited call.

Referring to the sequence of occurrence of the general control steps, displayed in FIG. 11, and to the other figures depicting an embodiment of the present invention, this lift system operates as follows. When for instance the down call button 111 on the ninth floor is depressed, all lift cage control means 1,2,3 . . . will during the next call reading cycle find this call through the adaptor circuit 36, whereafter they all operate in similar manner as shall now be related regarding lift No. 1, up to the point where it is mentioned that the differences begin. The call reading programme observes when arriving at the ninth floor that a down call is present on the ninth floor, whereupon into the respective output of the call adaptor circuit 37,39 the information hereof is written, whereby the call remains in storage. Next, in the storage unit 25 this call datum is furnished with the external call marking of the battery because the lifts are operating in battery mode, not in reserve control mode, and because an external call is concerned. After this, the call reading programme moves to the next floor, and so one. The call processing of the battery programme starts with the synchronizing event 101 at the beginning of a selection cycle 107. The synchronisation is a signal which puts in step all lifts to perform the call search simultaneously. At the first stage 102 of the selection cycle only priority calls are reviewed. This function concerns calls which are in a special position. When the selection enters the normal calls selection step 103, the function is as follows. The programme checks that floor on which the lift 113 is standing or, if the lift is in motion, that floor which is the so-called anticipated location, that is the location at which the lift still has time to make a stop. If there is no call on this floor, the programme will form a waiting delay, whereupon the search proceeds to the next floor 114, and so on.

The delay inserted between reviews is fixed. Hereby all lifts perform call searching at the same speed, whereby the nearest lift 113 will in the normal situation find the free call and book it 118. The booking takes place as follows. First, an entry is made in the own table, whereupon the booking information is transferred to the signalling programmes to be further transmitted to the other lifts, and finally the booked call is transferred to the drive control programmes, which further processes the call—for instance, in stationary situation generates the direction of driving and starts the motors, etc.

At this stage the operation of the other lifts begins to differ from that of the lift just considered, because they are located at greater distance and they have not yet found the call. Let us now consider the operation of lift No. 4. The message reception programme, which operates completely independently in the receiving situation, receives the call booking information from lift No. 1, whereupon it operates as follows. The signal received is interpreted, and since a call is concerned, data transfer into the call table of storage unit 25 is performed. The next time when it is the turn of the selection programme to be run, it will with this lift find the notation that this call has been booked by another lift, with the consequence that this lift disregards the call and, instead, continues to search for a suitable call. These events are played through in all lifts except that which has booked the call. The call processing further includes several functions which in the interest of simplicity are not described here.

During the next selection cycle the lifts operate in equal manner. The lift which selected the call sends out, as the seletion programme arrives at the floor in question, once more a booking signal; likewise it transfers the call to the drive programme and dispatches booking informations to the other lifts. Similarly, the other lifts behave as has been described for lift No. 4.

The result is that the final selection always takes place with an accuracy of one or a few storeys and as late as possible. Naturally, the battery control includes extra controls with an anticipating, correcting or equivalent nature and by means of which the overall operation of the battery can be effectivated.

When the lift which booked the call arrives at the location where commencement of retardation has to be implemented, the drive control is started. The implementation conforms to general microcomputer principles and shall not be more closely described here since it is outside the scope of the battery control procedure.

While the retardation is started, at the same time the lift which finally booked the call sends information hereof to the other lifts. The next time when it is the turn to run these other lifts' call reading programmes, they find with the respective lift the notation that the call has been booked, whereupon regarding this fact a storage unit-internal message is transmitted, whereby the light control 106 of the calls is started, which sets to zero the external memory in the respective call line, with the effect that the respective end stage no longer grounds the call line. These events take place in all lifts but that which finally booked the call. When the lift that made the final booking comes to a stand-still, this causes the call light to be extinguished, using the same programme 106.

| FIG. 11 START | | | |
|---|---|---|---|
| Included in battery | | | Reserve transmission |
| | Yes | | |
| Itself sending synch. | | Yes | Transmission of synchronization |

-continued

| FIG. 11 START | | | |
|---|---|---|---|
| Selection permitted | | | |
| | Yes | | |
| Congestion situation ON | | Yes | Get rush period control conditions |
| Processing of prioritized calls | | | |
| Suitable call found | Yes | | |
| Processing of normal calls | | | |
| Suitable call found | Yes | | |
| Low traffic conditions | | | |
| Booking required | Yes | | Perform call booking |
| Miscellaneous control messages being transmitted | | | |
| Testing signals | | | |
| Control of call lights | | | |

I claim:

1. An improvement in a control system for a battery of elevators in which a plurality of elevator cars serve a plurality of levels in a building; each of said levels being provided with means for making calls therefrom and means for determining the location of respective elevator cars; said elevator cars being provided with means for making calls therefrom; and location means for determining the location of the elevator cars, control means for said elevator cars, said control means having at least one microcomputer with at least one microprocessor; and said control means further having an elevator car drive means and control apparatus for controlling the elevator car drive means, wherein the improvement comprises: providing said control means with a number of data processing units, each of said data processing units having at least one microcomputer; said data processing units being adapted to jointly control the battery of elevator cars, with each respective unit having an equal position in relation to one another, being dependent upon the other units and provided with data concerning external calls of the elevator battery.

2. An elevator control system according to claim 1, in which each data processing unit comprises, a system route connected to at least one microcomputer, at least one storage unit, and at least one data transfer unit, wherein: a route isolator is connected to the system route of each data processing unit, being formed to have another route constructed on the other side thereof, and which is galvanically isolated from the system route.

3. An elevator control system, according to claim 1, in which each data processing unit comprises, a system route connected to at least one microcomputer, at least one storage unit, and at last one data transfer unit, wherein: a route isolator is connected to the system route of each data processing unit, being formed to have an elevator car route on the other side thereof, and which is galvanically isolated from the system route.

4. An elevator control system according to claim 1, wherein: all external calls are connected to respective control means of separate elevators in the battery participating in joint control.

5. An elevator control system according to claim 1, wherein: the data processing units participating in joint control, execute joint control of the elevator battery to operate mainly simultaneously and at the final stage of the data processing cycle, to provide the same information on external calls of said elevator battery.

6. An elevator control system according to claim 1, wherein: each elevator car control means is connected to external call storage unit as a joint memory storage for the data processing units of all elevator car control means.

7. An elevator control system according to claim 1, wherein: data arriving from the data processing unit to the drive means and from the drive means to the data processing unit, is transferred over a route isolator, and the data from the drive means may induce an interrupt to the data processing unit.

8. An elevator control system, according to claim 1, wherein: the storage units of the data processing units of the respective elevator cars, being under joint control of the elevator battery and contain a similar series of steps for each of the elevator cars to thereby implement elevator control strategy under joint control.

9. An elevator control system according to claim 8, wherein: the same data concerning external calls of the battery are present in all storage units of the data processing units, of the respective elevator cars participating at any given time in joint control.

10. An elevator control system according to claim 9, wherein: data processing units participating in joint control simultaneously perform joint control of the elvator car battery.

11. An elevator control system according to claim 10, wherein: the data transfer units are interconnected to provide at least one indirect path of communication from each elevator car control means to all other elevator car control means.

12. An elevator control system according to claim 10 wherein: the data transfer units are inter-connected to provide at least one direct path of communication from each of the respective elevator car control means to all other elevator car control means.

13. An elevator control system according to claim 12, wherein: the data processing units carry out a series of steps by providing signals over the data transfer units for transmission to the other data processing units, in such a manner, that data processing cycles are produced having the same length in all data processing units of the control means.

14. An elevator control system according to claim 13, wherein: any one of the data processing units transmitting or receiving signals, are adapted to transmit a first synchronizing signal, and failure by the data processing unit sending said synchronizing signal, permits any other data processing unit to start the next cycle by in turn transmitting synchronizing signals to the other data processing units.

15. An elevator control system according to claim 14, wherein: during the data processing cycle, each data processing unit carries out a first series of steps, and at least one external call is selected for each control means.

16. An elevator control system according to claim 15, wherein; each data processing unit when carrying out said first series of steps, observes a free call and carries out a second series of steps, whereby those data processing units while carrying out the first series of steps and which have as yet not observed the external call in question, receive notice of this booking during the first series of steps, before arriving in their stepping at the point where said external call is to be observed.

17. An elevator control system according to claim 15, wherein: each data processing unit when carrying out said first series of steps, observes a call furnished with a booking having a marking of lower rating compared to its own running condition, and carries out a second series of steps, whereby those data processing units while carrying out the first series of steps and which have as yet not observed the external call in question, receive notice of this booking during the first series of steps, before arriving in their stepping at the point where said external call is observed.

18. An elevator control system according to claim 16, wherein: as the second series of steps is being carried out, there is simultaneous execution of the first series of steps until all external calls have been processed, or until all check rounds have been made, the presence of additional external calls having a rank of lower rating compared to its own running condition, triggers repetition of second series of steps for said second call, in such a manner for each round, in which the rank position has a lower rating than in the preceding round, with the number of rounds not being greater than four.

* * * * *